United States Patent [19]

Katchka et al.

[11] Patent Number: 4,640,676

[45] Date of Patent: Feb. 3, 1987

[54] BURNER CONTROL DEVICE, SYSTEM AND METHOD OF MAKING THE SAME

[75] Inventors: Jay R. Katchka, Cypress; George A. Yeaman; Richard W. McKinney, both of Lakewood, all of Calif.

[73] Assignee: Robertshaw Controls Company, Richmond, Va.

[21] Appl. No.: 767,721

[22] Filed: Aug. 20, 1985

[51] Int. Cl.[4] ..... F23Q 9/08

[52] U.S. Cl. ..... 431/54; 431/80; 236/68 D

[58] Field of Search ..... 431/51–54, 431/56, 59, 80; 236/68 D, 15 A

[56] References Cited

U.S. PATENT DOCUMENTS

| | | | |
|---|---|---|---|
| 2,478,386 | 8/1949 | Gauger | 431/54 |
| 2,527,286 | 10/1950 | Witzel | 431/54 |
| 3,358,738 | 12/1967 | Chambers | 431/51 |
| 4,285,662 | 8/1981 | Katchka et al. | 431/53 |

*Primary Examiner*—Carroll B. Dority, Jr.
*Attorney, Agent, or Firm*—Candor, Candor & Tassone

[57] ABSTRACT

A control device for supplying fuel to a burner means, a system therefor and methods of making the same are provided, the device comprising a housing having an inlet for being interconnected to a source of fuel and having an outlet for being interconnected to the burner, first and second control valves carried by the housing and being in series to connect the inlet to the outlet only when both of the control valves are in an open condition thereof, each control valve comprising a movable valve member resiliently biased closed and an independent electromagnetic valve member latching unit energizable to hold its respective valve member open and deenergizable to allow its respective valve member to close, each control valve having a movable member to open its respective valve member to a latching position so as to be held open by its respective latching unit when its respective latching unit is energized, and a single manually movable actuator carried by the housing and having structure operatively interconnecting the movable members together so that the valve members will move substantially in unison to their latching positions as the actuator is being moved to an actuated position thereof.

15 Claims, 16 Drawing Figures

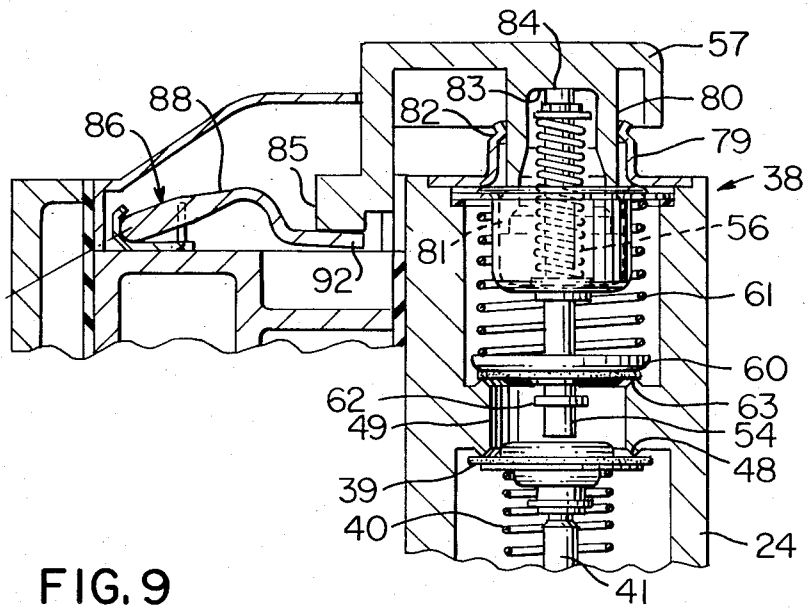
FIG. 9
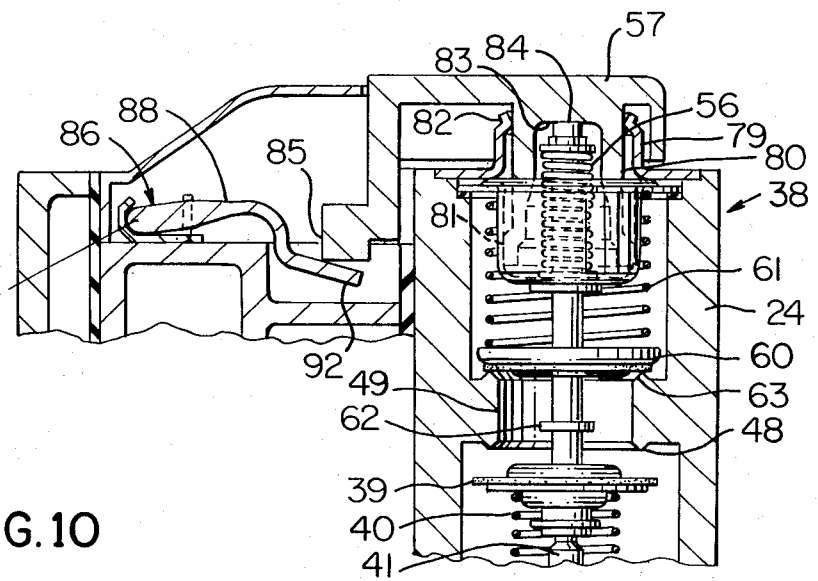
FIG. 10
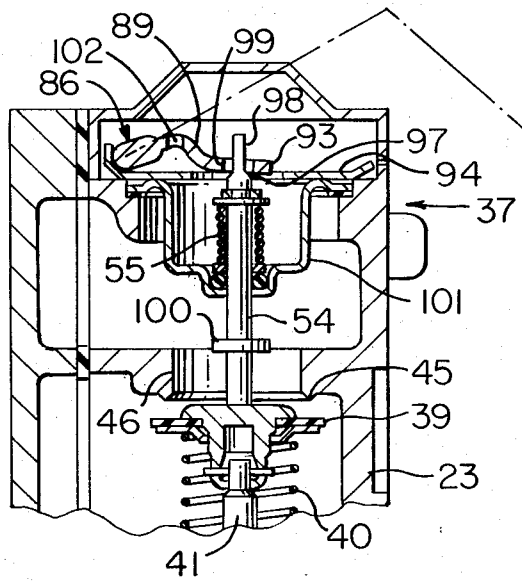
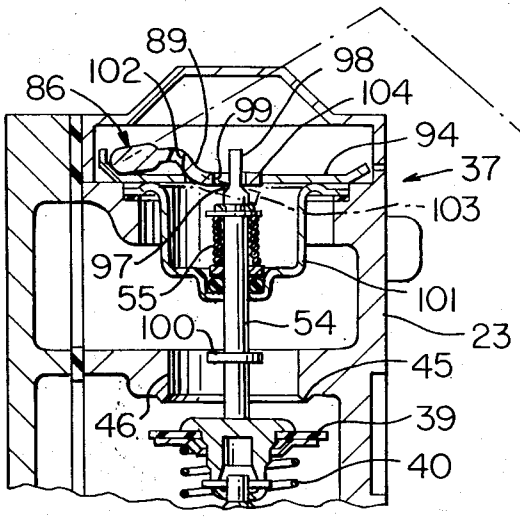

FIG. 13
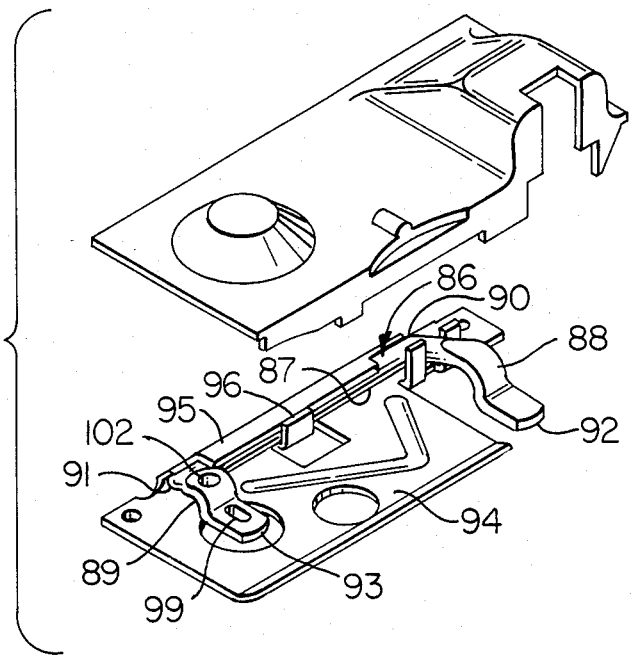
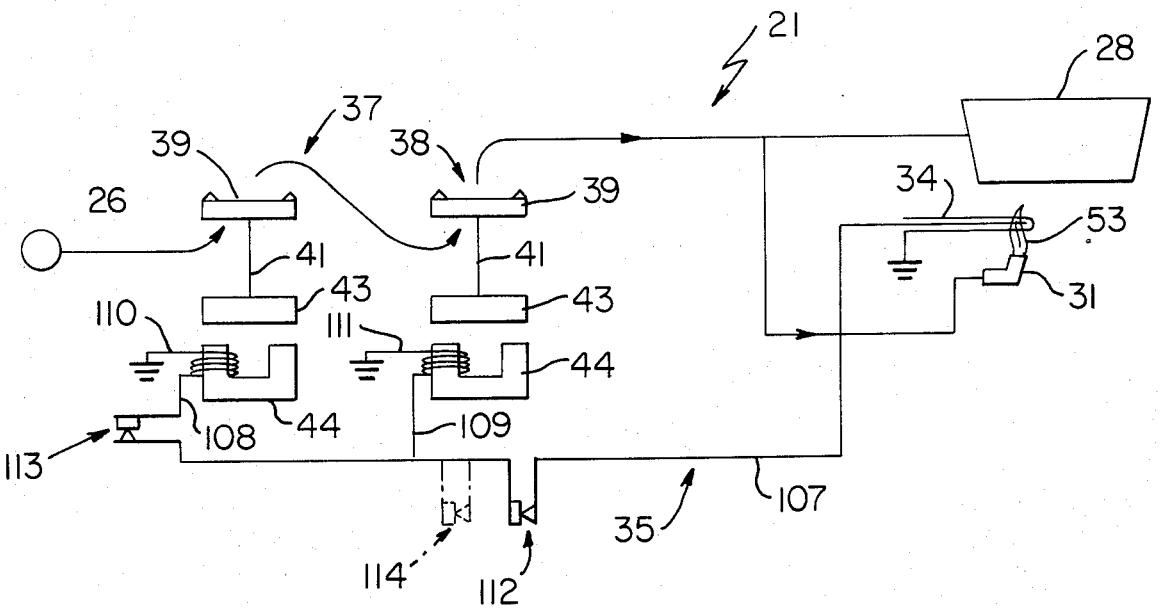
FIG. 14

BURNER CONTROL DEVICE, SYSTEM AND METHOD OF MAKING THE SAME

BACKGROUND OF THE INVENTION

1. Field of the Invention

This invention relates to a new control device for supplying fuel to a burner means as well as to a system therefor and methods of making the same.

2. Prior Art Statement

It is known to provide a control device for supplying fuel to a burner means, the device comprising a housing means having an inlet means for being interconnected to a source of fuel and having an outlet means for being interconnected to the burner means, and first and second control valve means carried by the housing means and being in series to connect the inlet means to the outlet means only when both of the control valve means are in an open condition thereof, each control valve means comprising a movable valve member, resiliently biased closed and an independent electromagnetic valve member latching means energizable to hold its respective valve member open and deenergize to allow its respective valve member to close, each control valve means having movable means to open its respective valve member to a latching position so as to be held open by its respective latching means when its respective latching means is energized. For example, see the U.S. Pat. No. 4,285,662 to Katchka et al.

It is also known to provide a control device for supplying fuel to a main burner means, the device comprising a housing means having an inlet means for being interconnected to a source of fuel and having a first outlet means for being interconnected to the main burner means and a second outlet means for being interconnected to a pilot burner means for the main burner means, and first and second control valve means carried by the housing means and being in series to connect the inlet means to the first outlet means only when both of the control valve means are in open condition thereof, each control valve means comprising a movable valve member resiliently biased closed and an independent electromagnetic valve member latching means energizable to hold its respective valve member open and deenergizable to allow its respective valve member to close, each control valve means having movable means to open its respective valve member to a latching position so as to be held upon by its respective latching means when its respective latching means is energized. For example, see the aforementioned U.S. Pat. No. 4,285,662 to Katchka et al.

SUMMARY OF THE INVENTION

It is one feature of this invention to provide a new control device for supplying fuel to a burner means wherein the two control valve means of the control device are adapted to be opened substantially in unison to their latching positions as a single actuator means is being moved to an actuated position thereof.

In particular, it was found that when the control device set forth in the aforementioned U.S. Pat. No. 4,285,662 to Katchka et al, is to have the pilot burner means controlled thereby ignited, each control valve means of the prior known control device must have the actuator means thereof individually operated in order to move its respective valve member to its latching position thereof.

However, it was found according to the teachings of this invention, that unique means can be provided so that a single actuator member can be utilized to move the valve members of the control valve means substantially in unison to their latching positions as the single actuator member is being moved to an actuated position thereof.

For example, one embodiment of this invention provides a control device for supplying fuel to a burner means, the device comprising a housing means having an inlet means for being interconnected to a source of fuel and having an outlet means for being interconnected to the burner means, first and second control valve means carried by the housing means and being in series to connect the inlet means to the outlet means only when both of the control valve means are in an open condition thereof, each control valve means comprising a movable valve member resiliently biased closed and an independent electromagnetic valve member latching means energizable to hold its respective valve member open and deenergizable to allow its respective valve member to close, each control valve means having movable means to open its respective valve member to a latching position to as to be held open by its respective latching means when its respective latching means is energized, and a single manually movable actuator means carried by the housing means and comprising a push button-like member and means operatively interconnecting the movable means together and being operatively associated with said push button-like member so that the valve members will move substantially in unison to their latching positions as the actuator means is being moved to an actuated position thereof.

It is another feature of this invention to provide a control device for supplying fuel to a main burner means wherein the two control valve means of the control device must both be in an open condition thereof before fuel can flow to the outlet means for the pilot burner means of the main burner means that is also controlled by the control device.

In particular, it was found that when the control device set forth in the aforementioned patent to Katchka et al, U.S. Pat. No. 4,285,662 is utilized for initially directing fuel to the pilot burner means, only one of the control valve means of the control device had to be moved to the open condition thereof in order to supply fuel to the pilot burner means for the main burner means that is also controlled by that control device.

However, it was found according to the teachings of this invention that the control valve means can be uniquely arranged so that both control valve means must be in an open condition thereof in order to supply fuel to the outlet means that leads to the pilot burner means for the main burner means that is also controlled by the control device.

For example, one embodiment of this invention provides a control device for supplying fuel to a main burner means, the device comprising a housing means having an inlet means for being interconnected to a source of fuel and having a first outlet means for being interconnected to the main burner means and a second outlet means for being interconnected to a pilot burner means for the main burner means, and first and second control valve means carried by the housing means and being in series to connect the inlet means to the first outlet means only when both of the control valve means are in an open condition thereof, each control valve means comprising a movable valve member resiliently biased closed and an independent electromagnetic valve member latching means energizable to hold its respective valve member open and deenergizable to allow its respective valve member to close, each control valve means having movable means to open its respective valve member to a latching position so as to be held open by its respective latching means when its respective latching means is energized, the control valve means being arranged to interconnect the inlet means to the second outlet means only when both of the control valve means are in an open condition thereof.

Accordingly, it is an object of this invention to provide a new control device for supplying fuel to a burner means, the device of this invention having one or more of the novel features of this invention as set forth above or hereinafter shown or described.

Another object of this invention is to provide a new method for making such a control device, the method of this invention having one or more of the novel features of this invention as set forth above or hereinafter shown or described.

Another object of this invention is to provide a new system for supplying fuel to a burner means, the system of this invention having one or more of the novel features of this invention as set forth above or hereinafter shown or described.

Another object of this invention is to provide a new method of making such a system, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 9 is a view similar to FIG. 8 and illustrates the control valve means when the reset button is initially being moved toward its actuating position.

FIG. 10 is a view similar to FIG. 9 and illustrates the control valve means when the actuator button has been moved to the fully actuated position thereof.

FIG. 13 is an exploded perspective view of the lever means of the control device of FIG. 1 for operatively interconnecting together the two control valve means of the control device of this invention.

FIG. 14 is a schematic view illustrating the new system of this invention.

DESCRIPTION OF THE PREFERRED EMBODIMENTS

Figure 1:
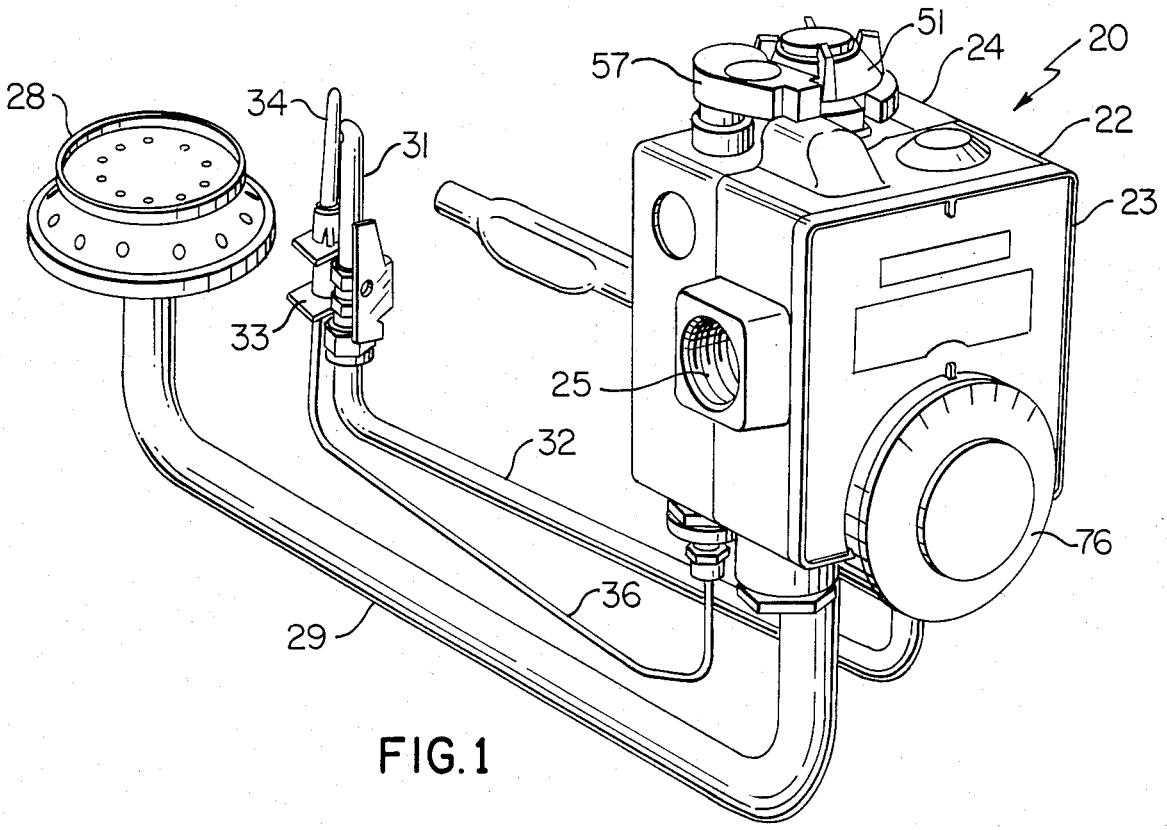
FIG. 1 is a perspective view of the new control device of this invention, the control device being interconnected to a main burner means and to a pilot burner means for the main burner means.

While the various features of this invention are hereinafter illustrated and described as being particularly adapted to provide a control device for supplying gaseous fuel to a burner means, such as from a source of liquid petroleum (L.P.) gas, it is to be understood that the various features of this invention can be utilized singly or in various combinations thereof to provide a control device for supplying other types of fuel as desired.

Therefore, this invention is not to be limited to only the embodiment illustrated in the drawings, because the drawings are merely utilized to illustrate one of the wide variety of uses of this invention.

Figure 2:
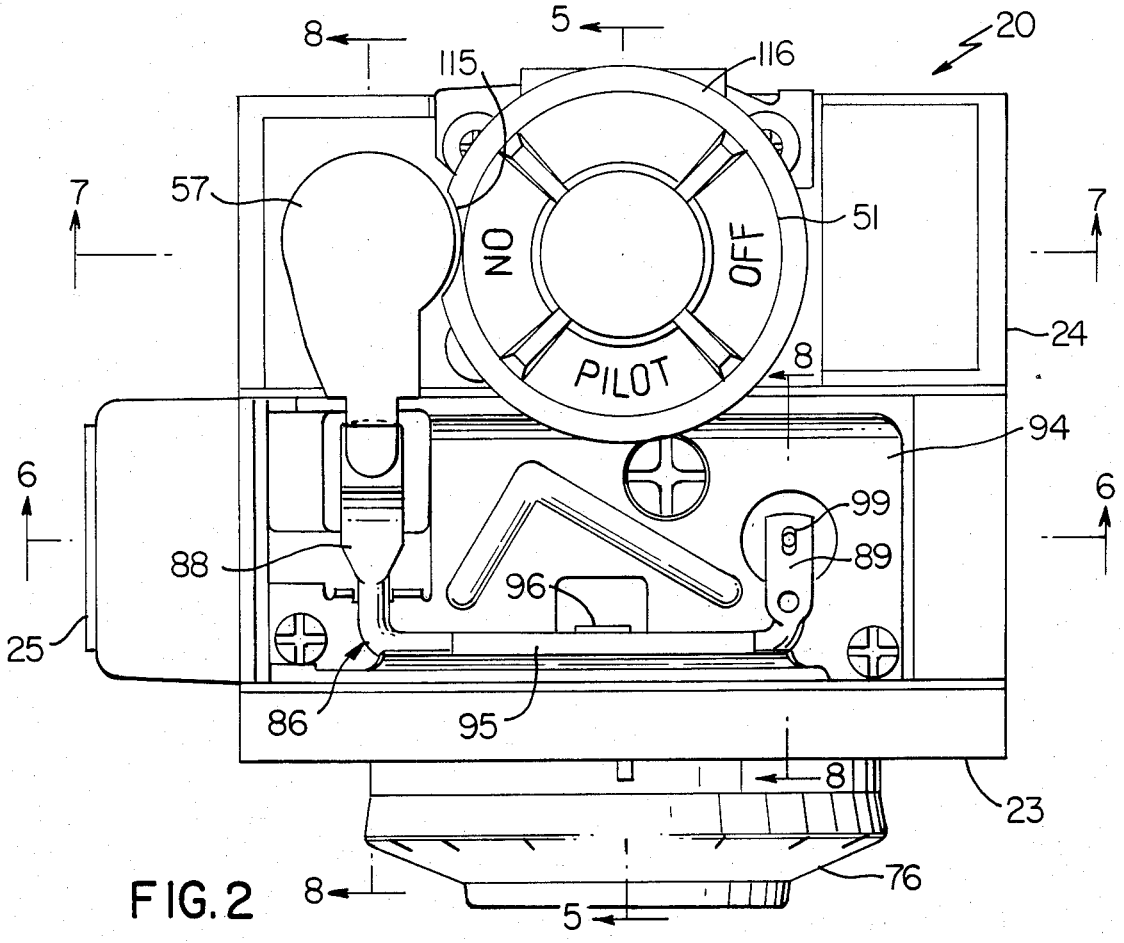
FIG. 2 is an enlarged top view of the control device of FIG. 1.

Referring now to FIGS. 1 and 2, the new control device of this invention is generally indicated by the reference numeral 20 and is so constructed and arranged in a manner hereinafter set forth that the control device 20 is adapted to be utilized to provide part of the new system of this invention that is generally indicated by the reference numeral 21 in FIG. 14.

The control device 20 comprises a housing means 22 formed of two main housing parts or sections 23 and 24 suitably secured together and having an inlet means 25 for being interconnected to a source of fuel 26, FIG. 14, such as liquid petroleum (L.P.) gas, and an outlet 27 adapted to be interconnected to a main burner means 28 by a conduit means 29 in a manner well known in the art, the burner means 28 being utilized to heat a suitable structure, such as a domestic water heater tank. The housing means 22 also has another outlet means 30, FIG. 7, adapted to be interconnected to a pilot burner means 31 for the main burner means 28 by a conduit means 32 in a manner well known in the art, the pilot burner means 31 being carried by a suitable bracket means 33 that also carries a flame sensing means 34 that comprises a single thermocouple that is interconnected into an electrical circuit portion 35, FIG. 14, of the system 21 by a conductor means 36, FIG. 1, in a manner well known in the art and in the manner set forth in the aforementioned U.S. Pat. No. 4,285,662 to Katchka et al.

Thus, since the general use, structure and operation of the control device 20 and system 21 of this invention is similar to the control device and system set forth in the aforementioned U.S. Pat. No. 4,285,662 to Katchka et al, this patent is being incorporated into this disclosure by this reference thereto.

Figure 6:
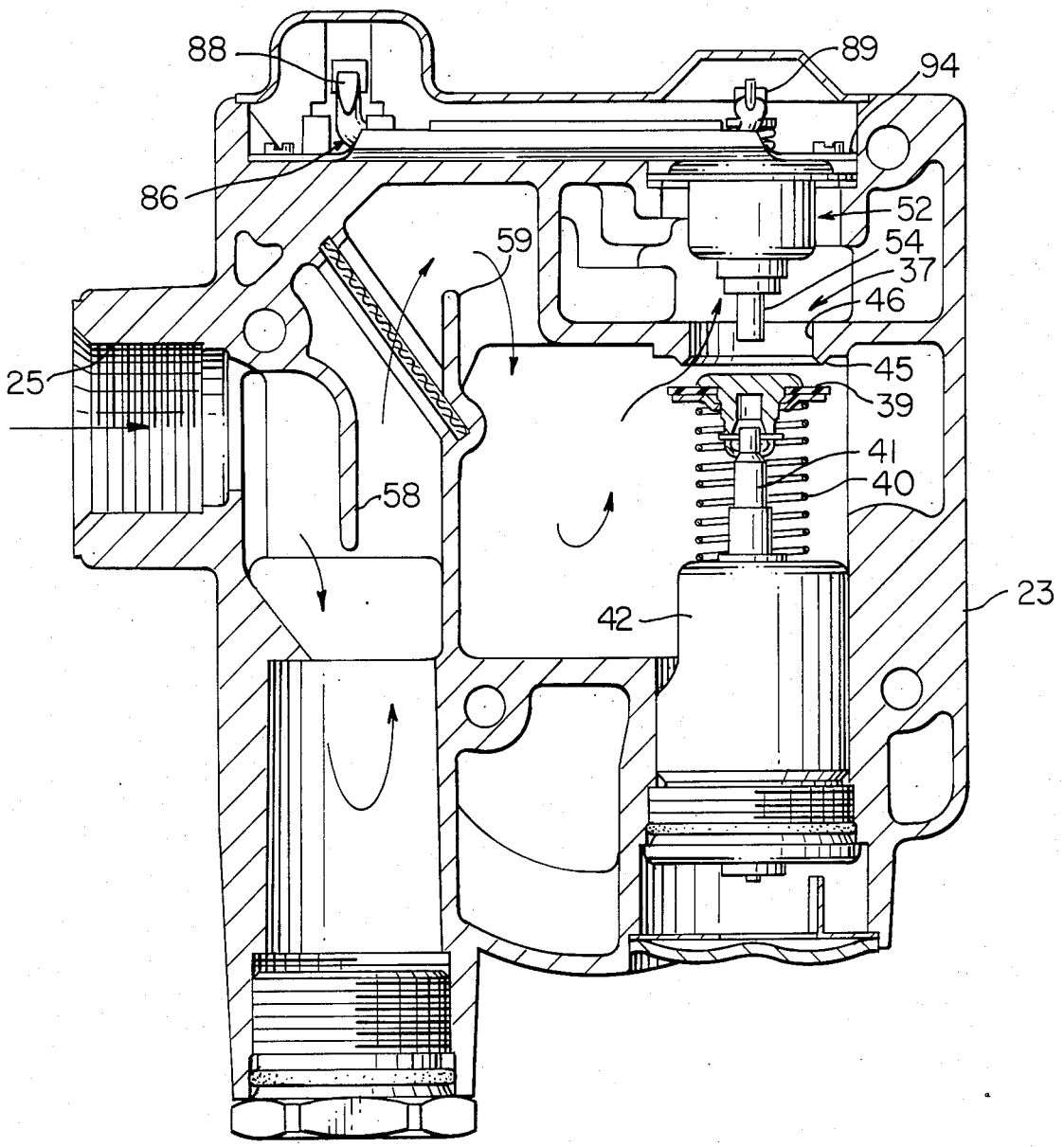
FIG. 6 is a cross-sectional view taken on line 6—6 of FIG. 2.
Figure 7:
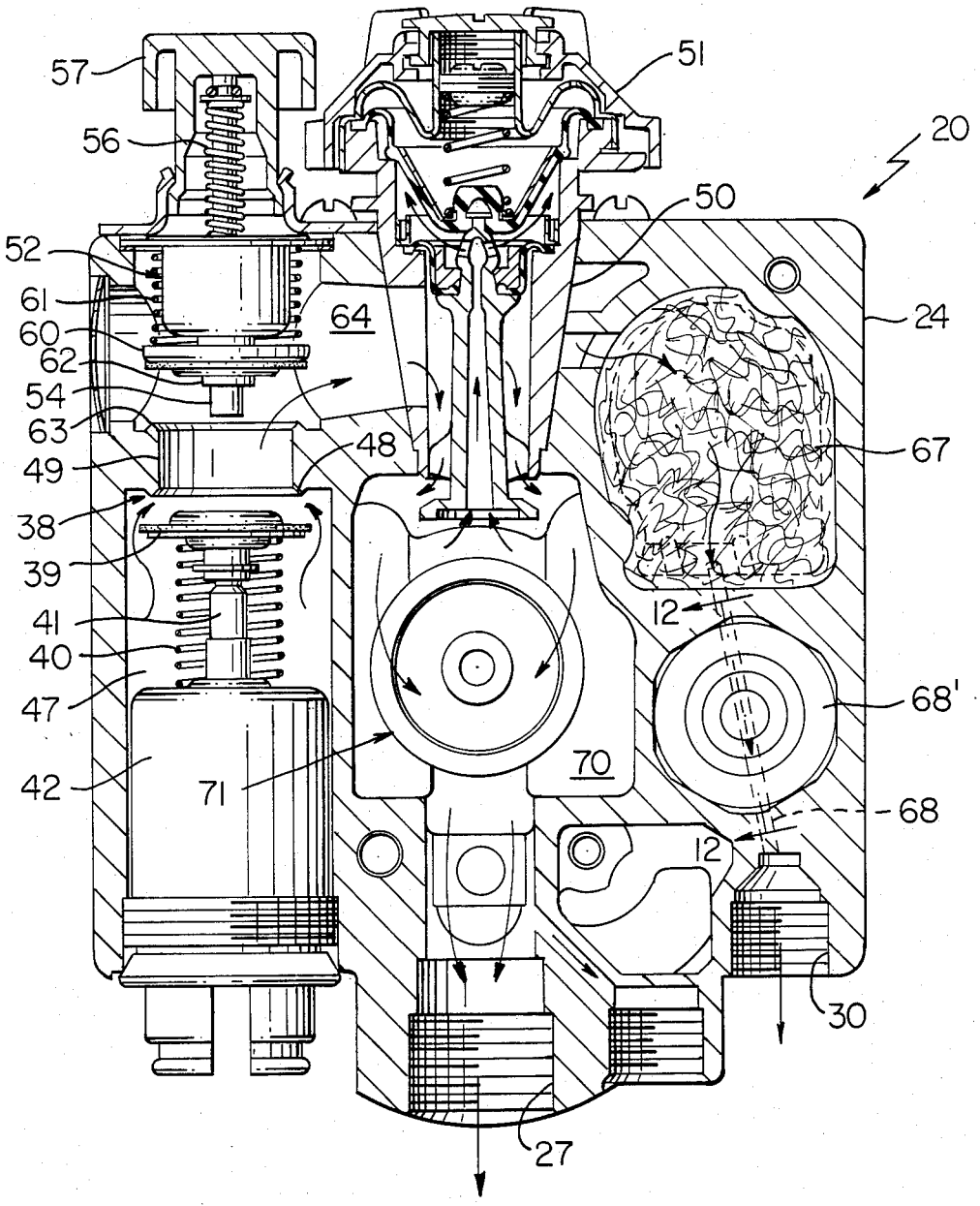
FIG. 7 is a cross-sectional view taken on line 7—7 of FIG. 2.

The control device 20 has two control valve means contained therein and being respectively generally indicated by the reference numerals 37 and 38 in FIGS. 6 and 7, the control valve means 37 and 38 each comprising a movable valve member 39 normally resiliently urged toward its closed position by a compression spring 40 and being carried on a rod means 41 that has a portion thereof disposed within a cylinder member 42 and carrying an armature 43 that is adapted to be positioned adjacent an electromagnetic coil means 44 in the bottom of the cylinder means 42 which comprises a magnetic latching means for holding the armature 43 and, thus, the valve member 39 in an open position thereof in a manner well known in the art and in a manner hereinafter set forth when an electrical current flows through the respective coil means 44.

The valve member 39 of the control valve means 37 as illustrated in FIG. 6 is adapted to normally close against a valve seat 45 so as to prevent fuel flowing from the inlet 25 to pass through an opening 46 of the valve seat 45 that leads to an internal chamber 47 in the housing part 24, the chamber 47, in turn, leading to a valve seat 48 that is normally closed by the valve member 39 of the control valve means 38 so as to prevent fuel from flowing through an opening 49 of the valve seat 48 and leading to a conventional rotatable plug valve means 50 of the control device 20 that is adapted to be rotated to its various operating positions relative to the housing means 22 by a control knob means 51 in a manner conventional in the art and as hereinafter described.

The plug valve means 50 is of the type that is adapted to control the pressure of the fuel passing therethrough and since such a plug valve means is well known in the art, the pressure regulating structure and operation of the plug valve means 50 will not be further set forth.

The control valve means 37 and 38 each includes a movable means 52 that is adapted to move its respective valve member 39 from its closed condition to its open and latching position in opposition to the force of its respective compression spring 40 so that if the coil means 44 for the respective control valve means 37 or 38 is energized, the valve member 39 will be held in its open position as illustrated in FIGS. 6 or 7 as long as the respective coil means 44 is being energized by the thermocouple means 34 sensing the flame means 53, FIG. 14, of the pilot burner means 31 as will be apparent hereinafter.

Figure 8:
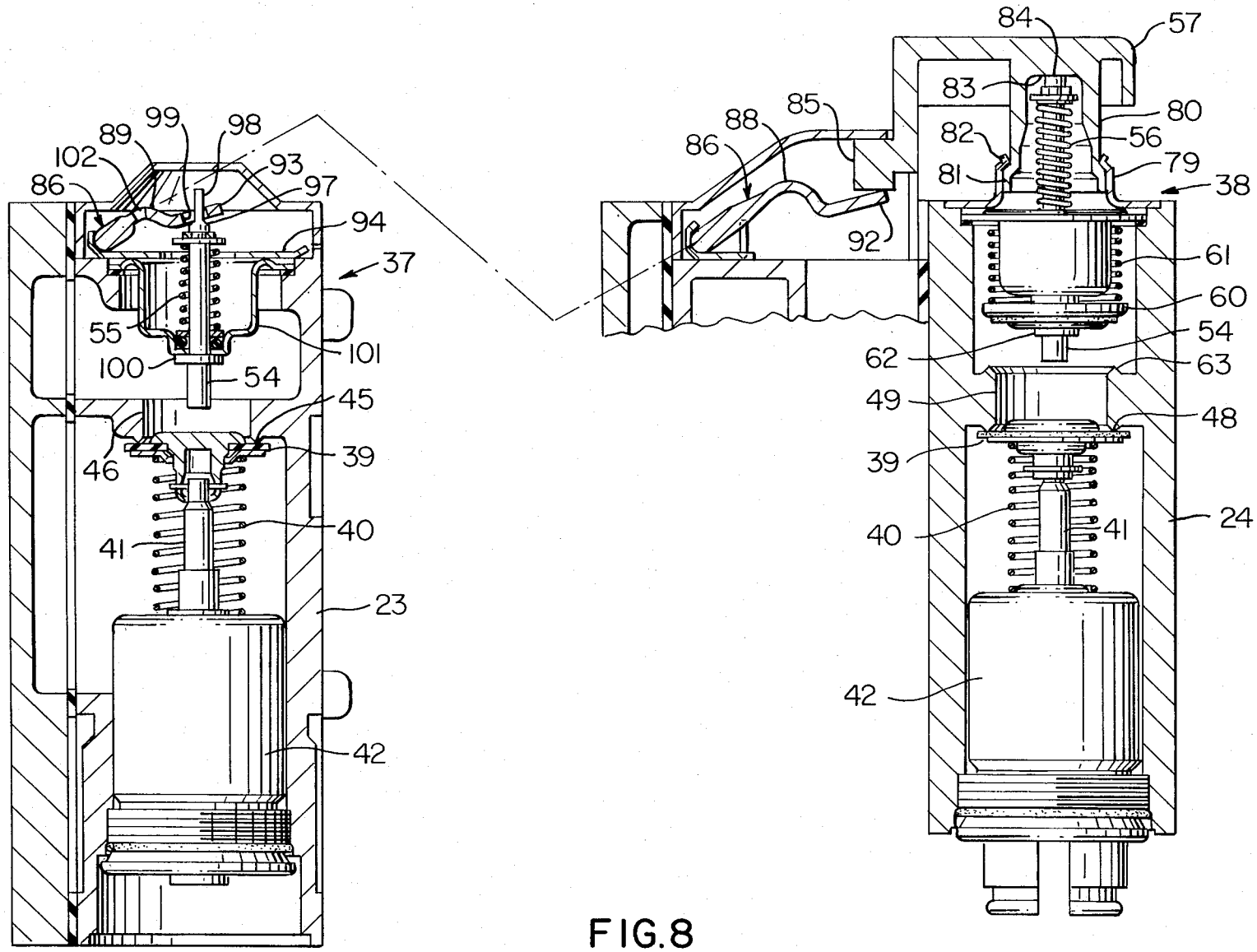
FIG. 8 is a fragmentary, stepped, cross-sectional view taken substantially on line 8—8 of FIG. 2 and illustrating the control valve means in the closed conditions thereof.

The movable means 52 for each control valve means 37 and 38 comprises a movable rod or plunger 54 movably carried by the housing means 22 and normally being biased away from its respective valve member 39 by a suitable spring means, such as spring means 55, FIG. 8, for the control valve means 37 and spring means 56, FIG. 8, for the control valve means 38.

However, the movable rod 54 of each control valve means 37 and 38 is adapted to be moved in a manner hereinafter set forth through the respective valve seat 45 or 48 to engage against its respective valve member 39 and move the valve member 39 from its closed position to its open and latching position where once the valve member 39 is being held in its latching position by its respective energized coil means 44, the movable member 54 can be moved back to its non-operating condition by the respective spring means 55 or 56 thereof and the valve member 39 will remain in its latched open position by the coil means 44 as long as the thermocouple means 34 is sensing the flame means 53 at the pilot burner means 31 as illustrated in FIG. 14.

A single reset button-like actuator member 57 is movably carried on the housing means 22 of the control device 20 and is adapted in a manner hereinafter set forth to move the movable means 52 of the control valve means 37 and 38 substantially in unison so as to cause the valve members 39 of the control valve means 37 and 38 to open and be moved to their latching positions as the single button-like actuator member 57 is being moved from its normal out or non-actuated position as illustrated in FIGS. 7 and 8 to its fully in or actuated condition as illustrated in FIG. 10 whereby the fuel can now issue from the pilot burner means 31, in a manner hereinafter set forth, and can be ignited. Once the control device 20 is creating the flame means 53 at the pilot burner means 31 and the flame means 53 is generating sufficient current through the coil means 44 to hold the valve members 39 in their latching positions, the actuator member 57 can be released from its actuated position and the spring means 55, 56 will not only return the movable rods 54 outwardly relative to the valve members 39, but will also return the actuator member 57 to its non-actuating position as illustrated in FIGS. 7 and 8 and in a manner that will be apparent hereinafter.

The fuel flow into the inlet 25 of the control device 20 of this invention is directed by baffle means 58 and 59 (see FIG. 6) in the housing part or section 23 to the valve seat 45 of the control valve means 37, the unique fuel flow path provided by the baffle means 58 and 59 being fully disclosed and claimed in the copending patent application Ser. No. 767,722, filed Aug. 20, 1985 of Jay R. Katchka whereby a further description of the fuel flow path from the inlet 25 to the control valve means 37 need not be set forth.

When the control valve means 37 of the control device 20 is disposed in the open condition as illustrated in FIG. 6, the flow of fuel through the opening 46 of the valve seat 45 is directed by passages in the housing 20 to the chamber 47 of the housing part or section 24 as illustrated in FIG. 7 and is adapted to enter the opening 49 of the valve seat 48 when the control valve means 38 is disposed in its open condition as illustrated in FIG. 7.

The movable member 54 of the control valve means 38 has a movable valve member 60 telescoped thereon and is biased toward the valve member 39 by a compression spring 61. However, an abutment 62 on the rod 54 normally holds the valve member 60 in the position illustrated in FIG. 8 as the spring 56 is stronger than the spring 61. However, when the actuator member 57 is pushed inwardly in the manner illustrated in FIG. 9, the valve member 60 follows the movement of the rod 54 until the valve member 60 engages against an annular valve seat 63 that closes the opening 49 of the valve seat 48 from a chamber 64 in the housing means 22 that leads to the plug valve means 50.

Thus, when the reset actuator member 57 is pushed inwardly for the purpose of igniting the pilot burner means 31, the valve member 60 prevents any flow of fuel through the control valve means 38 from reaching the plug valve member 50 and thus that could flow to the main burner means 28 as will be apparent hereinafter.

Figure 3:
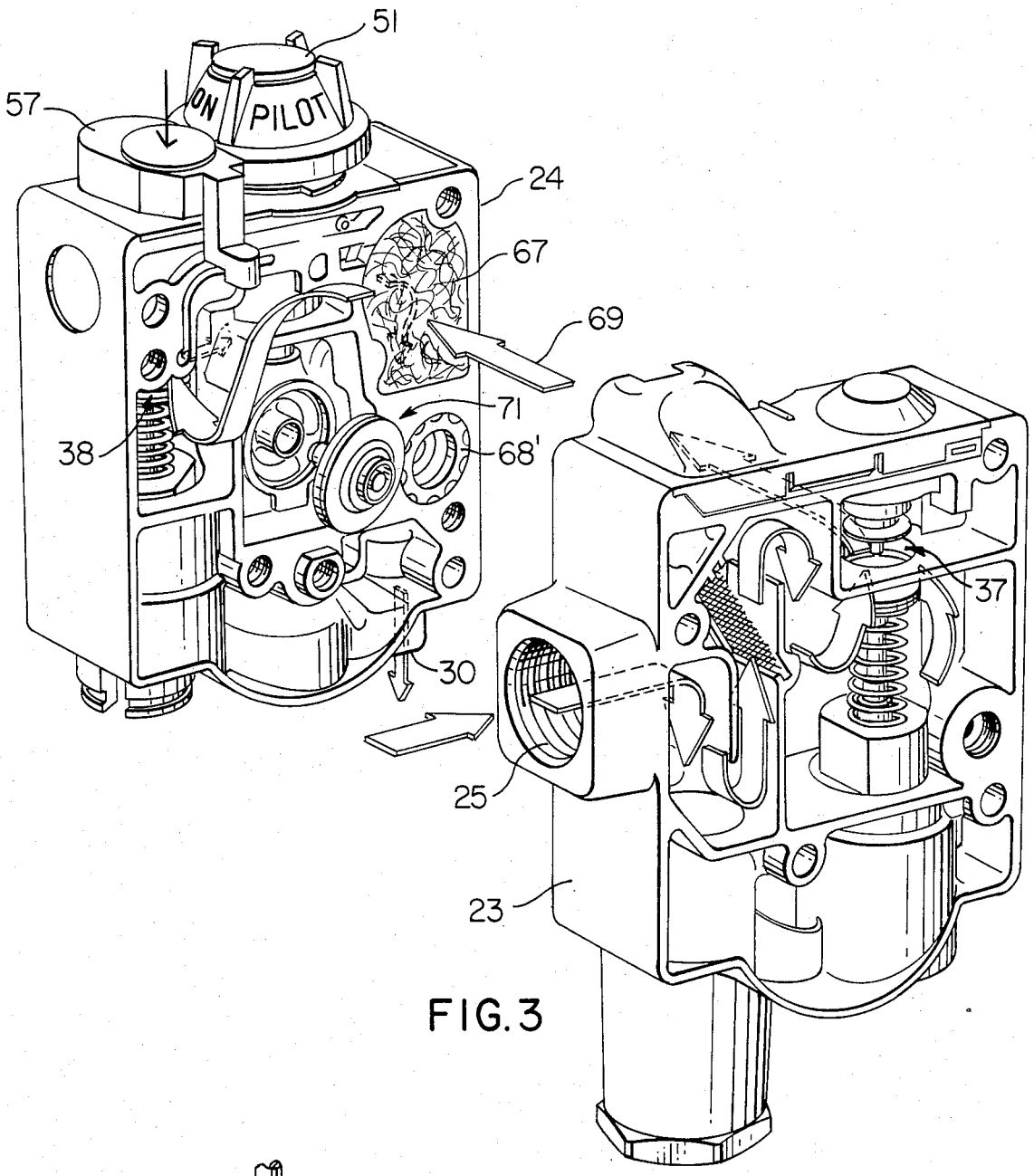
FIG. 3 is an exploded perspective view of the control device of FIG. 1 and schematically illustrates the fuel flow through the control device when the control device is set in its "PILOT" position and the reset button thereof has been actuated.
Figure 3A:
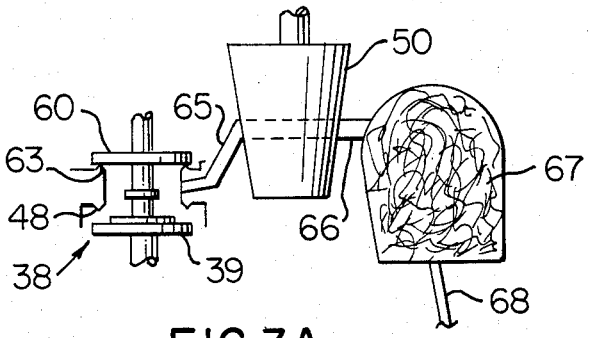
FIG. 3A is a schematic view of part of the valve means and fuel flow path of the control device in the condition of FIG. 3 thereof.
Figure 12:
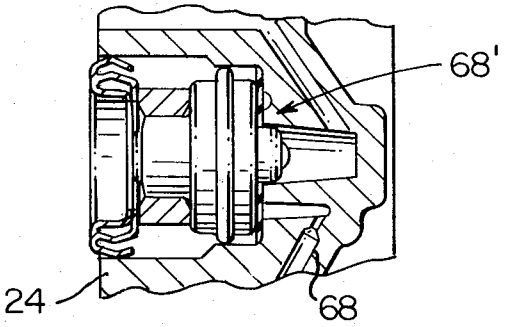
FIG. 12 is a fragmentary cross-sectional view taken on line 12—12 of FIG. 7 and illustrates the pressure regulator of the control device for regulating the pressure of the fuel that is directed to the pilot burner means.

However, the housing means 22 has a bypass passage 65 formed therein that leads from a point intermediate the valve seats 48 and 63 as illustrated in FIG. 3A to the plug valve member 50. The plug valve member 50 when disposed in its "PILOT" position as illustrated in FIGS. 3 and 3A has passage means that interconnects the bypass passage 65 with a housing passage 66 that leads to a filter chamber 67 in the housing member 24, the filter chamber 67, in turn, being connected with a housing passage 68 that leads to the pilot outlet 30 as illustrated in FIGS. 3, 3A and 7. The control device 20 has a conventional pilot pressure regulator 68', FIGS. 7 and 12 that controls the pressure of the fuel passing through the passage 68 to the pilot outlet 30 in a manner well known in the art.

In this manner, fuel is adapted to flow through the control device 20 to only the outlet 30 for the pilot burner 31 as represented by the arrows 69 in FIG. 3 when the reset actuator member or button 57 is pushed inwardly to its actuated position on the plug valve member 50 is disposed in the "PILOT" position thereof.

At this time, the fuel now issuing from the pilot burner 31 can be ignited to create the pilot flame means 53 and the flame means 53 causes the thermocouple means 34 to energize the coil means 44 and thereby hold the valve members 39 of the control valve means 37 and 38 in the open positions thereof as illustrated in FIG. 14.

Once the actuator member is subsequently released the valve member 60 is moved away from the valve seat 63 by the abutment 62 on the plunger 54 pulling the valve member 60 therewith in opposition to the force of the compression spring 61 to the position illustrated in FIG. 7 so that the fuel can now flow through the opened valve seat 63 and enter the chamber 64 that leads to the plug valve member 50 which is still blocking the flow of the fuel to the main burner outlet 27 because the plug valve member 50 is still in the "PILOT" position thereof.

Figure 4:
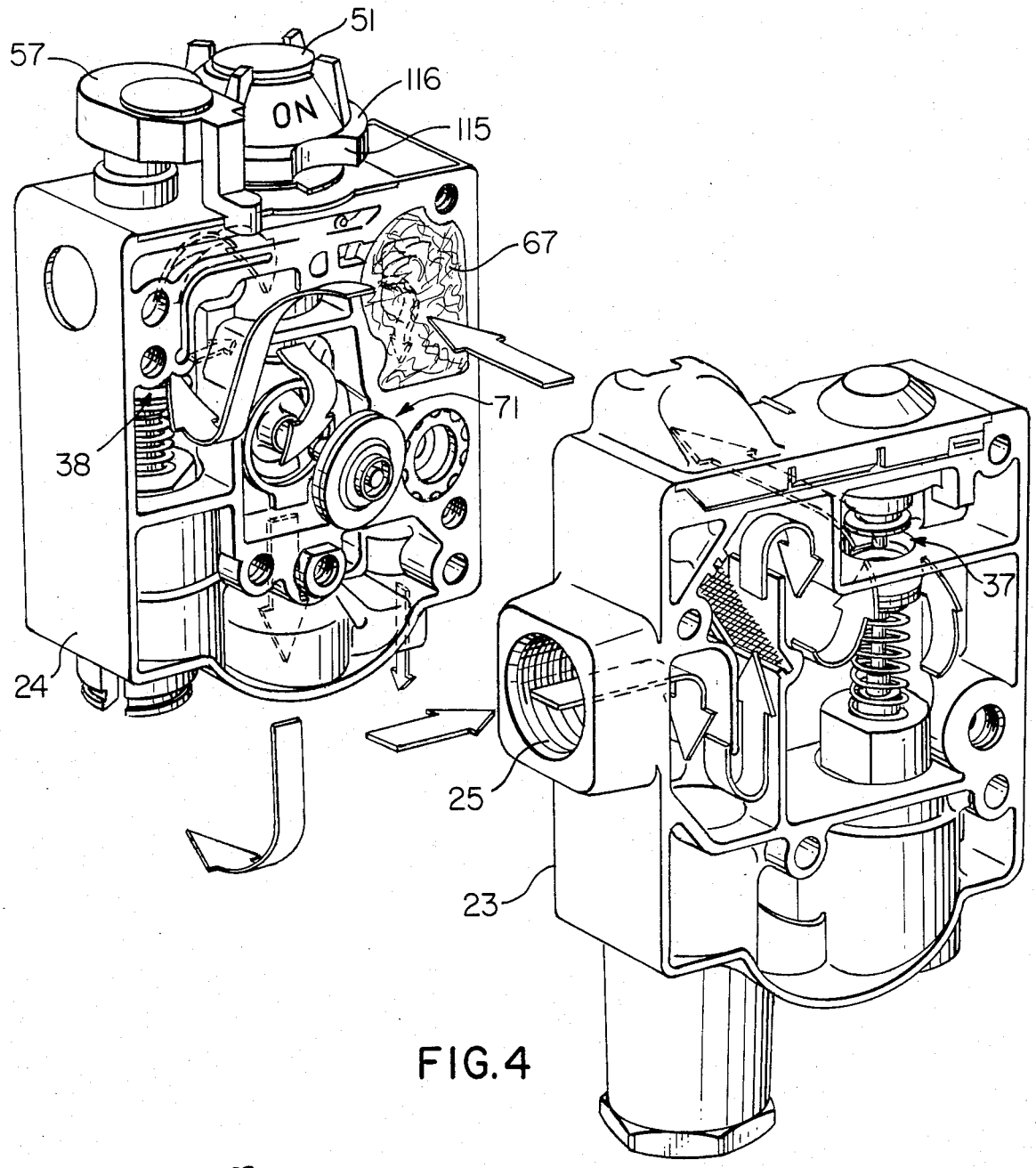
FIG. 4 is a view similar to FIG. 3 and illustrates the control device when set in the "ON" position thereof.
Figure 4A:
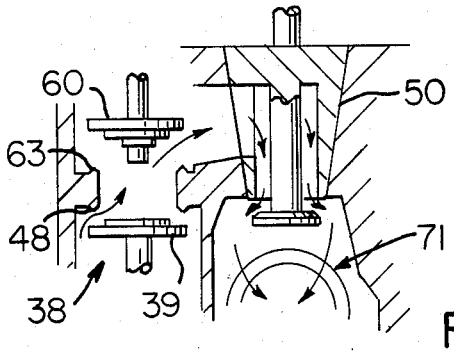
FIG. 4A is a view similar to FIG. 3A and schematically illustrates the fuel flow path through certain of the valve means of the control device when set in the condition of FIG. 4.
Figure 5:
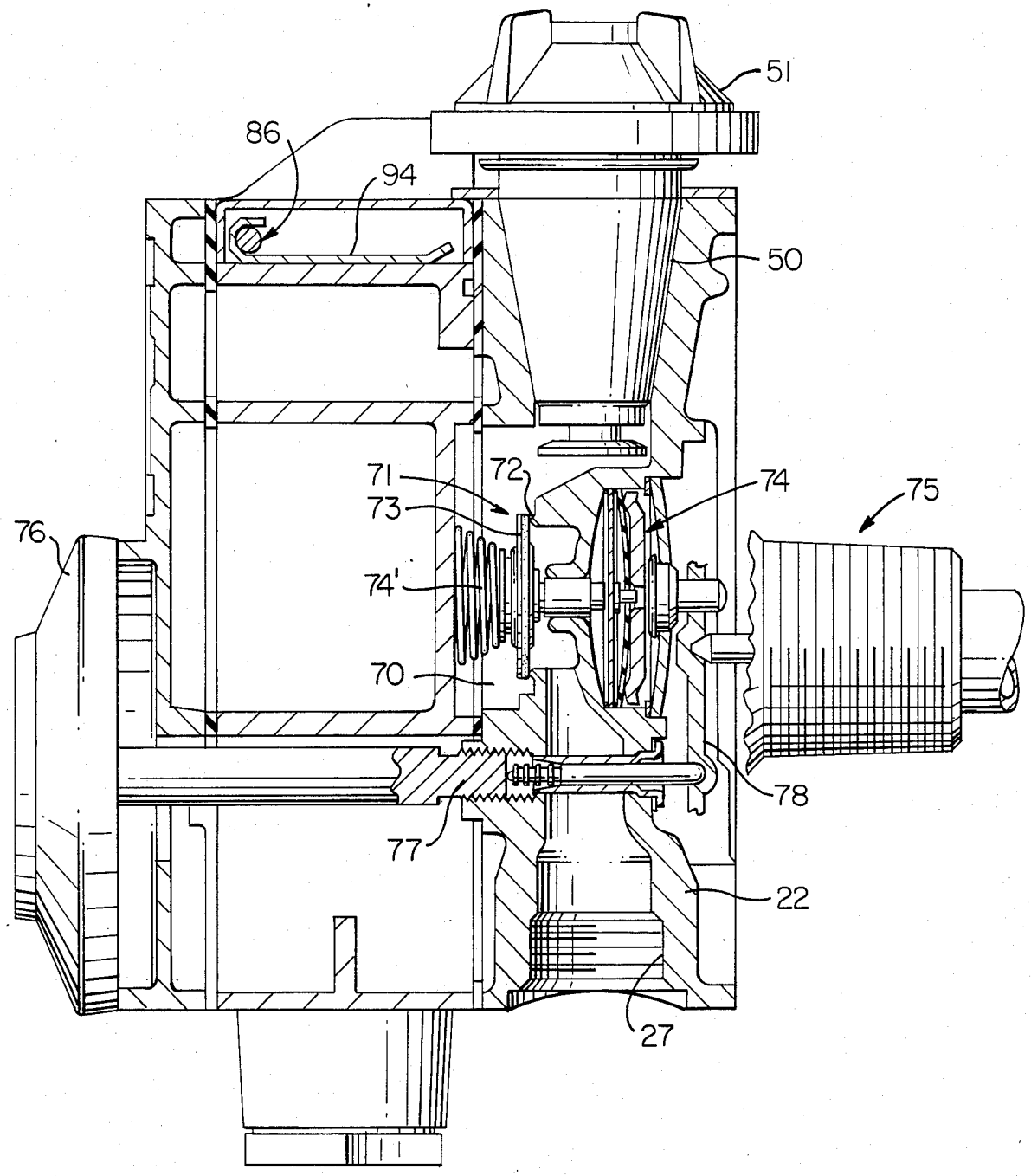
FIG. 5 is a cross-sectional view taken on line 5—5 of FIG. 2.

However, when the control knob 51 for the plug valve 50 is turned to the "ON" position as illustrated in FIGS. 4, 4A and 7, the plug valve member 50, in a manner well known in the art, directs the flow of fuel from the chamber 64 to an internal housing chamber 70 that leads to a thermostatically operated valve means 71, the thermostatically operated valve means 71 also being conventional in the art and is best illustrated in FIG. 5.

As illustrated in FIG. 5, the chamber 70 is separated from the outlet 27 by a valve seat 72 that is opened and closed by a valve member 73 that is normally urged to the closed position by a compression spring 74'.

However, the valve member 73 is adapted to be snapped open relative to the valve seat 72 by a conventional snap-clicker arrangement 74 that is operated by a rod and tube temperature sensing device 75 carried by the housing means 22, the temperature sensing device 75 having the actuating temperature setting thereof set by a temperature control knob 76 that operates a shaft means 77 that acts on a pivoting lever 78 in a manner well known in the art. Thus, with the control knob 76 set at a certain temperature setting thereof, the rod and tube temperature sensing means 75 will cause the clicker arrangement 74 to open the valve member 73 away from the valve seat 72 when the rod and tube temperature sensing means 75 senses an output temperature effect of the burner means 28 that is below the temperature setting of the control knob 76 and will cause the clicker arrangement 74 to permit the valve member 73 to close against the valve seat 72 under the force of the compression spring 74' when the rod and tube temperature sensing means 75 is sensing an output temperature effect of the burner means 28 that is above the temperature setting of the control knob 76.

In this manner, it can be seen that the control device 20 is now adapted to direct the flow of fuel through the thermostatic valve means 71 to the main burner means 28 to be ignited by the flame means 53 of the pilot burner means 31 each time the rod and tube temperature sensing device 75 senses that the burner means 28 should be producing heat, the rod and tube temperature sensing device 75 terminating the flow of fuel to the burner means 28 by closing the valve member 73 against the valve seat 72 when the output temperature effect of the burner means 28 that is being sensed by the rod and tube temperature sensing means 75 is above the setting of the control knob 76.

The housing section 24 of the housing means 22 of the control device 20 has a tubular member 79 secured thereto and telescopically receiving a tubular portion 80 of the actuator member or push button 57 which is outwardly flared at its end 81 to cooperate with an inwardly flared end 82 of the tubular member 79 so as to limit outward movement of the actuator member 57 relative to the housing member or section 24 in the manner illustrated in FIG. 8.

The tubular portion 80 of the actuator member 57 defines an end surface 83 against which the free end 84 of the actuating rod 54 of the control valve means 38 is disposed in abutting relation under the force of the compression spring 56 whereby the push rod 54 follows the movement of the actuator member 57 relative to the housing means 22.

The actuator member 57 has an extension or part 85 which is operatively interconnected to the push rod 54 of the control valve means 37 by an interconnecting lever 86 of this invention.

In particular, the lever 86 is formed of metal and is substantially U-shaped as defined by a substantially straight cross part 87 thereof and a pair of legs 88 and 89 respectively extending outwardly from the opposed ends 90 and 91 of the cross part 87, the legs 88 and 89 respectively having free ends 92 and 93.

The cross part 87 of the lever 86 is rotatably mounted to the housing means 22 of the control device 20 by being rotatably carried on a plate 94 that is secured to the housing part 23 and has flange means 95 and 96 disposed in a cooperating manner around the cross part 87 so that the cross part 87 can rotate on the plate 94 and thereby pivot the legs 88 and 89 relative thereto.

The end 92 of the leg 88 of the lever 86 is engaged by the part or extension 85 of the actuator member 57 as illustrated in FIG. 8 while the free end 93 of the other leg 89 engages against a shoulder means 97 of the push rod 54 of the control valve means 37 as a reduced end 98 of the push rod 54 passes through an opening 99 in the free end 93 of the leg 89, the spring 55 of the push rod 54 tending to move the push rod 54 of the control valve means 37 toward the leg 89 until an abutment 100 carried by the push rod 54 abuts against a stationary retainer 101 fixed to the housing means 22 in the manner illustrated in FIG. 8.

In this manner, as the actuator member 57 is moved downwardly from its completely out position as illustrated in FIG. 8, the part 85 pushes downwardly on the arm 88 of the lever 86 in the manner illustrated in FIG. 9 to cause the lever 86 to pivot in a clockwise direction in FIG. 9 and thereby push the push rod 54 of the control valve means 37 downwardly so that the push rod 54 of the control valve means 37 is engaged against the valve member 39 thereof to move the valve member 39 away from the valve seat 45. Substantially simultaneously, the end surface 83 of the actuator member 57 is moving the push rod 54 of the control valve means 38 downwardly therewith so that the push rod 54 of the control valve means 38 can engage against the valve member 39 of the control valve means 38 to open the same away from its valve seat 48.

However, before the push rod 54 of the control valve means 38 can open its valve member 38 away from the valve seat 48, the valve member 60 carried by the push rod 54 completely engages against its valve seat 63 in the manner illustrated in FIG. 9 so that further downward movement of the actuator member 57 from the position illustrated in FIG. 9 to the position illustrated in FIG. 10 causes the valve member 39 of the control valve means 38 to open away from its valve seat 48 as the push rod 54 can move relative to the now stopped valve member 60.

The lever 86 of this invention is so constructed and arranged that the leg 89 thereof is adapted to be deformed to a calibrated position thereof the first time the lever 86 is utilized in a particular control device 20 in a manner now to be described as it is desired to have the valve member 39 of the control valve means 37 open just slightly before the valve member 39 of the control valve means 38 opens.

In particular, the arm 89 of the lever 87 has an opening 102 passing therethrough adjacent to the end 91 of the cross part 87 so as to weaken this portion of the arm 89, the arm 89 being initially bent relative to the arm 88 so that the same will fully move the valve member 39 of the control valve means 37 away from the valve seat 45 well before the actuator member 57 will move the valve member 39 of the control valve means 38 away from its valve seat 48 as illustrated in FIG. 9.

However, as the initial downward movement of the actuator member 57 continues from the position illustrated in FIG. 9 to the position illustrated in FIG. 10, normally the pre-bent arm 89 of the lever 86 would have been moved downwardly to the dash-dotted line position indicated by the reference numeral 103 in FIG. 10 when the actuator member 57 has been moved completely inwardly to its full inward position as determined by the actuator member 57 engaging against the housing means 22 and/or having the stem 41 of the valve member 39 of the control valve means 38 bottom out in its respective cylinder 42 so that the actuator member 57 cannot be moved further downwardly from the position illustrated in FIG. 10.

However, because the arm 89 had been pre-bent relative to the arm 88, this initial downward movement of the actuator member 57 from the position illustrated in FIG. 9 to the position illustrated in FIG. 10 causes the stem 41 of the valve member 39 of the control valve means 37 to first bottom out in its cylinder 42 before the bottoming out of the stem 41 of the valve member 39 of the control valve means 38 so that the arm 89 is bent back in a counterclockwise direction in FIG. 10 at the area of the weakening opening 102 while the actuator member 57 is causing the valve member 39 of the control valve means 38 to move to its bottom out position whereby the arm 89 of the lever 86 is bent to the condition indicated by the reference numeral 104 in FIG. 10 at the time the actuator member 57 is stopped in its full inward depressed condition.

Figure 11:
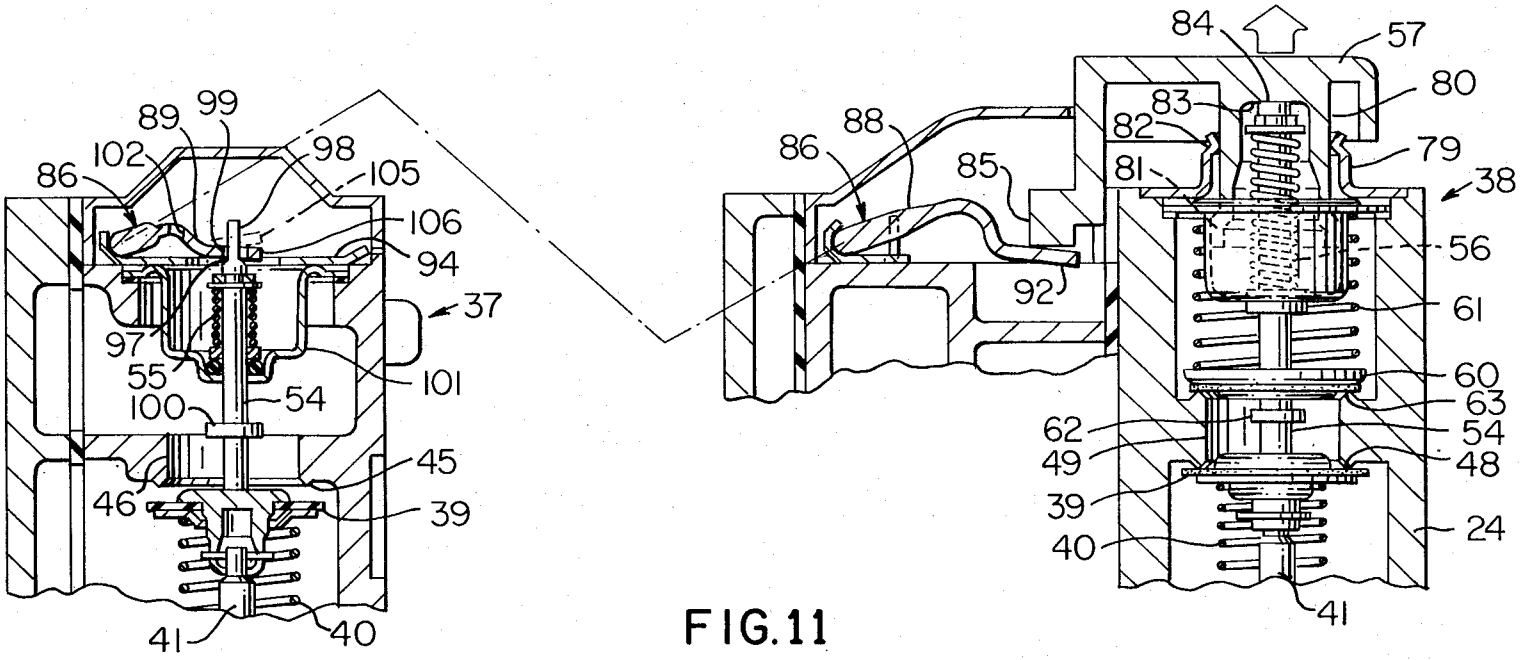
FIG. 11 is a view similar to FIG. 8 and illustrates the control valve means after the reset button has been released and has partially moved back toward its non-actuated position.

Thereafter, subsequent releasing of the actuator member 57 in the manner illustrated in FIG. 11 causes the actuator member 57 to move upwardly under the force of the springs 55 and 56 (also under the force of the springs 40 until the valve members 39 seat against their respective valve seats 45 and 48). However, the previous bending of the arm 89 of the lever 86 by the first depressed condition of the actuator member 57 in the manner illustrated in FIG. 10 causes the arm 89 to have a slight spring back condition thereof so that if the arm 89 had remained in its fully bent condition as represented by the reference numeral 104 in FIG. 10 after the actuator member 57 had been released in the manner illustrated in FIG. 11, the arm 89 would have taken the dash-dotted position illustrated by the reference numeral 105 in FIG. 11 but because of the slight spring back thereof, the arm 89 takes the position represented by the reference numeral 106 in FIG. 11 thereby insuring that each time the actuator member 57 is subsequently depressed to open the control valve means 37 and 38, the valve member 39 of the control valve means 37 will open slightly before the valve member 39 of the control valve means 38 will open.

The electrical circuit 35 of the control system 21 of this invention as illustrated in FIG. 14 comprises a lead 107 that extends from the thermocouple means 34 and has two branch leads 108 and 109 respectively interconnected to the coil means 44 of the control valve means 37 and 38 so that the coil means 44 are disposed in parallel between the lead 107 and ground as represented by the lead means 110 and 111 respectively for the coil means 44 in FIG. 14.

The lead 107 for the control system 21 has a temperature operated electrical switch means 112 disposed therein intermediate the branch lead 109 and the thermocouple means 34 to sense the output temperature effect of the burner means 28 so as to open the lead 107 should the output temperature effect of the burner means 28 exceed a predetermined limit so as to disconnect the coil means 44 of the control valve means 37 and 38 from thermocouple means 34 and thereby cause the control valve means 37 and 38 to close when the switch means 112 opens. For example, should the control system 21 be utilized for heating water in a water heater tank, the switch means 112 can be set to open at a sensed temperature of the water in the tank at or above approximately 194° F. and thereby terminating the flow of fuel to the burner means 28 should the temperature exceed 194° F. If desired, the switch means 112 can be of the type that once the switch means 112 is opened in the above manner, the switch means 112 must be replaced by a new switch means 112.

The system 21 includes a second temperature operated electrical switch means 113 disposed in the branch 108 that leads to the coil means 44 for the control valve means 37 with the switch 113 being set to open when the same senses ambient temperature at the control device 20 exceeding a certain value. For example, the temperature operated switch means 113 can open when the same senses a temperature of approximately 250° F. and thereby causing the closing of the control valve means 37 which will cause the system 21 to thereby terminate the flow of fuel to the burner means 28 as well as to the pilot burner means 31 so that the switch means 113 prevents the control system 21 from supplying fuel to the main burner means 28 when the same senses ambient temperature adjacent the control device 20 that is above the selected actuating temperature thereof.

While the switch means 113 is illustrated in FIG. 14 as being in the branch 108, it is to be understood that the same could also be located in the lead 107 in advance of the branch 109 as illustrated in dash-dotted lines in FIG. 14 and generally indicated by the reference numeral 114 so that the opening of the switch 114 in response to the ambient temperature adjacent the control 20 exceeding a certain value will cause both coil means 44 of the control valve means 37 and 38 to be disconnected from the thermocouple means 34 to terminate the flow of fuel to the burner means 28 in the same manner as the switch 112 when the switch 112 opens.

If desired, the switch 113 or 114 can be of the same one-actuation type as the switch 112 previously described.

From the above, it can be seen that the control device 20 and the system 21 of this invention can be formed from the various parts previously described by the methods of this invention as previously described to operate in a manner now to be described.

With the control device 20 of this invention disposed in the system 21 of this invention so that the fuel source 26 is interconnected to the inlet means 25 and the outlet means 27 and 30 are respectively interconnected to the main burner means 28 and the pilot burner means 31, and since initially there is no flame means 53 existing at the pilot burner means 31, the coil means 44 of the control valve means 37 and 38 are in their deenergized condition whereby the valve members 39 thereof are respectively seated against their valve seats 45 and 48 so as to prevent any flow of fuel to the pilot burner means 31 and the main burner means 28 even though the thermostatically operated valve means 71 might be in an open condition because the control knob 76 has been set at a temperature setting that requires the rod and tube temperature sensing device 75 to maintain the thermostatically operated valve means 71 in an open condition thereof.

Therefore, to initially ignite the pilot burner means 31 in order to cause full operation of the system 21, the operator first turns the temperature dial 76 to the "OFF" position thereof so that the thermostatically operated valve means 71 will be disposed in the closed position illustrated in FIG. 5. The operator then rotates the control knob 51 of the plug valve means 50 to the "PILOT" position thereof as illustrated in FIG. 2 whereby a cutout 115 of an annular flange means 116 of the control knob 51 is disposed adjacent to the reset actuator member 57 to permit the reset actuator member 57 to be depressed relative to the control knob 51, flange means 116 of the control knob 51 being conventional in the art so that when the control knob 51 is set in any other position than in the "PILOT" position thereof, the flange means 116 is underneath the actuator member 57 when the actuator member 57 is in its out condition and thereby prevents the actuator member 57 from being depressed inwardly from its out position when the control knob 51 is in any position other than the "PILOT" position thereof.

Thus, with the control knob 51 of the plug valve means 50 disposed in the "PILOT" position as illustrated in FIG. 2, the push button 57 is depressed downwardly from the position illustrated in FIG. 8 to the position illustrated in FIG. 9 so that even though the valve member 39 of the control valve means 37 is now in an open condition so that fuel can flow from the inlet means 25 through the open valve seat 45 to the chamber 47 of the control valve means 38, the valve member 39 of the control valve means 38 remains closed until after the valve member 60 is disposed against the valve seat 63 so that even though the valve member 39 of the control valve means 38 now opens in the manner illustrated in FIG. 10, the valve member 60 prevents any fuel from flowing through the valve seat 48 of the control valve means 38 and reaching the plug valve means 50 so that even though the plug valve means 50 is in a position to prevent fuel to flow to the thermostatic valve means 71, the valve member 60 likewise prevents any flow of fuel to the thermostatic valve means 71.

With the push button 57 fully depressed in the manner illustrated in FIG. 10, it can be seen from FIGS. 3 and 3A that fuel is now permitted to flow through the bypass passage 65 in the housing means 22 from a point intermediate the valve seats 48 and 63 and through the plug valve means 50, passage 66, filter chamber 67, passage 68 and pilot outlet 30 to the pilot burner means 31 so as to issue therefrom.

At this time, the issuing fuel from the pilot burner means 31 can be ignited either manually or automatically as the case may be so as to create the flame means 53 which is now sensed by the thermocouple means 34.

After the pilot burner 31 has been lit in the above maner to produce the flame means 53, the operator maintains the push button 57 in its depressed condition long enough for the thermocouple 34 to generate sufficient electrical current to flow through the coil means 44 of the control valve means 37 and 38 so that the energized coil means 44 acting on the armatures 43 maintain the armatures 43 in their latching position so that the valve members 39 of the control valve means 37 and 38 will be held in their open position by the energized coil means 44 even though the reset actuator member 57 is released, such holding period being approximately 60 seconds after the pilot burner 31 is initially ignited.

Once the pilot flame 53 is established, and the valve members 39 of the control valve means 37 and 38 are latched in their open positions by the energized coil means 44, the reset actuator means 57 can be released and the actuator means 57 is moved outwardly by the spring means in the manner previously described so that the push rods 54 of the control valve means 37 and 38 move upwardly in the drawings and the valve member 60 of the push rod 54 of the control valve means 38 is moved upwardly therewith so as to open the valve seat 63 and thereby permit the flow of fuel through the valve seat 45 to now reach the plug valve member 50.

At this time, the operator turns the control knob 51 to the "ON" position thereof as illustrated in FIGS. 4 and 4A so that fuel can now flow through the plug valve means 50 to the thermostatically operated valve means 71 as well as to continuously flow to the pilot burner means 31 to maintain the pilot flame 53 in a manner well known in the art.

The operator then turns the temperature dial 76 to the desired temperature setting so that the rod and tube temperature sensing means 75 will open the valve member 73 of the thermostatically operated valve means 71 away from the valve seat 72 when the temperature sensing means 75 is sensing an output temperature effect of the burner means 28 that is below the temperature setting of the control knob 76. The opened thermostatic valve means 71 now permits fuel to flow from the plug valve means 50 through the outlet 27 to the main burner means 28 to be ignited by the continuously burning pilot flame 53 whereby the burner means 28 continues to burn until the temperature sensing means 75 senses that the output temperature effect of the burner means 28 has reached the temperature setting of the control knob 76 at which time the temperature sensing means 75 causes the clicker means 74 to permit the valve member 73 to close against the valve seat 72 under the force of the compression spring 74' to terminate the flow of fuel to the main burner means 28 so that the main burner means 28 no longer creates any heating flame means.

However, the pilot burner 31 continues to have the flame means 53 so that the flame means 53 is adapted to reignite the main burner means 28 when the thermostatically operated valve means 71 again opens because the temperature sensing means 75 is sensing that the output temperature effect of the burner means 28 has fallen below the temperature setting of the control knob 76.

Thus, the control system 21 and control device 20 of this invention continues to operate in the manner previously described so as to tend to maintain the output temperature effect of the burner means 28 at the temperature setting of the dial 76.

However, if during such operation of the control system 21 and control device 20 of this invention, should the pilot flame 53 cease to exist, the thermocouple means 34 in a manner well known in the art will cool and thus cease to generate electrical current through the coil means 44 of the control valve means 37 and 38 so that the control valve means 37 and 38 will have the valve members 39 thereof moved to their closed position by the spring means 40 to thereby completely terminate the flow of fuel to the main burner means 28 as well as to the pilot burner means 31 whereby the pilot burner means 31 must be relit in the manner previously described by utilizing the reset actuator means 57 as previously described.

Likewise, if during the previously described continuous operation of the control system 21 and control device 20, should the switch means 112 sense that the output temperature effect of the burner means 28 has exceeded the setting of the switch means 112, the switch means 112 will open and, thus, terminate the flow of electrical current to the coil means 44 so that the control valve means 37 and 38 will close and thereby terminate the flow of fuel not only to the main burner means 28 but also to the pilot burner means 31 so that the pilot burner means 31 will have to be subsequently relit by utilizing the reset actuator means 57 in the manner previously described and after the switch means 112 has been reset or been replaced as the case may be.

Similarly, should the switch means 113 sense an ambient temperature above the ambient temperature setting thereof during the continuous operation of the control system 21 and control device 20 in the manner previously described, the opening of the switch means 113 will terminate the flow of current to the coil means 44 of the control valve means 37 so that the valve member 39 thereof will close and thereby terminate the flow of fuel not only to the main burner means 28, but also to the pilot burner means 31 and the termination of the flame means 53 at the pilot burner means 31 will now stop the flow of electrical current to the coil means 44 of the control valve means 38 so that the control valve means 38 will also now close. Of course, if the switch means 114 is being used in place of the switch means 113, the opening of the switch means 114 will initially terminate the flow of electrical current to both of the coil means 44 so that both control valve means 37 and 38 will close in the same manner as previously described for the opening of the switch means 112. In any event, the pilot burner means 31 will have to be subsequently relit by utilizing the reset actuator means 57 in the manner previously described and after the switch means 113 or 114 has been reset or been replaced as the case may be.

Therefore, it can be seen that by utilizing the unique lever means 86 of this invention, the single reset actuator means 57 can be utilized to substantially simultaneously open the control valve means 37 and 38 for pilot lighting purposes and the control device 20 of this invention has the control valve means 37 and 38 so constructed and arranged that both of the control valve means 37 and 38 must be disposed in the open condition thereof before fuel can be supplied to the pilot burner means 31, let alone be supplied to the main burner means 28 as previously described.

Therefore, it can be seen that this invention not only provides a new control device and a new system for supplying fuel to a main burner means, but also this invention provides new methods of making such a control device and such a system.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device for supplying fuel to a burner means, said device comprising a housing means having an inlet means for being interconnected to a source of fuel and having an outlet means for being interconnected to said burner means, and first and second control valve means carried by said housing means and being in series to connect said inlet means to said outlet means only when both of said control valve means are in an open condition thereof, each said control valve means comprising a movable valve member resiliently biased closed and an independent electromagnetic valve member latching means energizable to hold its respective said valve member open and deenergizable to allow its respective said valve member to close, each said control valve means having movable means to open its respective said valve member to a latching position so as to be held open by its respective said latching means when its respective said latching means is energized, the improvement comprising a single manually movable actuator means carried by said housing means and comprising a push button-like member and means operatively interconnecting said movable means together and being operatively associated with said push button-like member so that said valve members will move substantially in unison to their said latching positions as said actuator means is being moved to an actuated position thereof.

2. A control device as set forth in claim 1 wherein said means operatively interconnecting said movable means together opens said valve member of said first control valve means before opening said valve member of said second control valve means as said actuator means is initially being moved to its said actuated position.

3. A control device as set forth in claim 1 wherein both of said control valve means are disposed inside said housing means.

4. A control device as set forth in claim 1 wherein said means operatively interconnecting said movable means together comprises a lever pivotally carried by said housing means.

5. A control device as set forth in claim 4 wherein said lever is substantially U-shaped and thereby has a cross part provided with opposed ends and a pair of legs extending from said opposed ends of said cross part.

6. A control device as set forth in claim 5 wherein said cross part of said lever is rotatably mounted to said housing means so that said pair of legs pivot relative to said housing means, one of said legs being engageable with said movable means of said first control valve means to move said valve member thereof to said latching position thereof when said one leg pivots in one direction to a certain position thereof.

7. A control device as set forth in claim 6 wherein said push button-like member has a portion engageable with the other of said legs of said lever to pivot said one leg to said certain position thereof when said push button-like member is pushed to said actuated position thereof.

8. A control device as set forth in claim 7 wherein each said control valve means has a valve seat that is adapted to be closed by its respective said valve member, said lever being so constructed and arranged that said valve member of said first control valve means opens away from its respective valve seat before said valve member of said second control valve means opens away from its respective said valve seat as said push button-like member is being initially pushed toward its said actuated position.

9. In a control system supplying fuel to a main burner means from a source of said fuel, said system comprising a fuel line means leading from said source to said main burner means, a housing means, and first and second control valve means carried by said housing means and disposed in series in said line means to connect said source to said main burner means only when both of said control valve means are in an open condition thereof, each said control valve means comprising a movable valve member resiliently biased closed and an independent electromagnetic valve member latching means energizable to hold its respective said valve member open and deenergizable to allow its respective said valve member to close, each said control valve means having movable means to open its respective said valve member to a latching position so as to be held open by its respective said latching means when its respective said latching means is energized, the improvement comprising a single manually movable actuator means carried by said housing means and comprising a push button-like member and means operatively interconnecting said movable means together and being operatively associated with said push button-like member so that said valve members will move substantially in unison to their said latching positions as said actuator means is being moved to an actuated position thereof.

10. A control system as set forth in claim 9 wherein said means operatively interconnecting said movable means together opens said valve member of said first control valve means before opening said valve member of said second control valve means as said actuator means is initially being moved to its said actuated position.

11. A control system as set forth in claim 9 wherein said means operatively interconnecting said movable means together comprises a lever pivotally carried by said housing means.

12. A control system as set forth in claim 11 wherein said lever is substantially U-shaped and thereby has a cross part provided with opposed ends and a pair of legs extending from said opposed ends of said cross part.

13. A control system as set forth in claim 12 wherein said cross part of said lever is rotatably mounted to said housing means so that said pair of legs pivot relative to said housing means, one of said legs being engageable with said movable means of said first control valve means to move said valve member thereof to said latching position thereof when said one leg pivots in one direction to a certain position thereof.

14. A control system as set forth in claim 13 wherein said push button-like member has a portion engageable with the other of said legs of said lever to pivot said one leg to said certain position thereof when said push button-like member is pushed to said actuated position thereof.

15. A control system as set forth in claim 14 wherein each said control valve means has a valve seat that is adapted to be closed by its respective said valve member, said lever being so constructed and arranged that said valve member of said first control valve means opens away from its respective valve seat before said valve member of said second control valve means opens away from its respective said valve seat as said push button-like member is being initially pushed toward its said actuated position.

* * * * *